US005527028A

United States Patent [19]

Ishikawa

[11] Patent Number: 5,527,028

[45] Date of Patent: Jun. 18, 1996

[54] AUTOMATIC SHEET FEEDING DEVICE

[75] Inventor: Noriyoshi Ishikawa, Yokohama, Japan

[73] Assignee: Canon Kabushiki Kaisha, Tokyo, Japan

[21] Appl. No.: 425,778

[22] Filed: Apr. 20, 1995

Related U.S. Application Data

[63] Continuation of Ser. No. 75,835, Jun. 14, 1993, abandoned.

[30] Foreign Application Priority Data

Jun. 22, 1992 [JP] Japan ..... 4-162944
May 10, 1993 [JP] Japan ..... 5-108229

[51] Int. Cl.[6] ..... B65H 3/06

[52] U.S. Cl. ..... 271/114; 271/116; 271/126; 271/251

[58] Field of Search ..... 271/10, 114, 116, 271/126, 251, 109, 256, 272, 10.01

[56] References Cited

U.S. PATENT DOCUMENTS 4,461,465 7/1984 Hartman, Jr. et al. ..... 271/126 X
4,682,769 7/1987 Murakami et al. ..... 271/10
5,167,409 12/1992 Higeta ..... 271/251 X

FOREIGN PATENT DOCUMENTS 1135 1/1982 Japan ..... 271/251

*Primary Examiner*—David H. Bollinger
*Attorney, Agent, or Firm*—Fitzpatrick, Cella, Harper & Scinto

[57] ABSTRACT

A sheet feeding device includes a feeding unit for feeding a mounted sheet, a first drive transmission unit for selectively transmitting a drive to the feeding unit, a conveying unit for conveying the sheet fed by the feeding unit, a second drive transmission unit for selectively transmitting a drive to the conveying unit, and a supporting member for integrally supporting the above-described units.

22 Claims, 10 Drawing Sheets

AUTOMATIC SHEET FEEDING DEVICE

This application is a continuation of application Ser. No. 08/075,835 filed Jun. 14, 1993, now abandoned.

BACKGROUND OF THE INVENTION

1. Field of the Invention

This invention relates to an automatic sheet feeding device for use in or with an image forming apparatus, such as a copier, a printer, and a facsimile apparatus, that records on a recording medium, such as paper, an OHP (overhead projector) sheet, and an envelope.

2. Description of the Related Art

FIG. 8 illustrates a laser-beam-printer recording apparatus using an electrophographic recording technique as a conventional apparatus. To improve reliability in this type of sheet feeding apparatus, a sheet is linearly conveyed (this type is hereinafter termed a straight type) to perform recording.

In the straight type, however, the space for inlet and exit units for a sheet are added to the main body of the apparatus, causing an increase in the space needed for installing the apparatus.

In order to overcome this problem, a U-like configuration as illustrated in FIG. 9 or an S-like configuration as illustrated in FIG. 10, in which a conveying path for a sheet is inverted to reduce the actual space needed to install the recording apparatus, has been mostly adopted.

A method has also been proposed in which a sheet is conveyed while grasping only an end portion of the sheet with a conveying roller and an obliquely-oriented roller and pressing a reference side of the sheet against a conveyance reference guide of the main body of an image forming apparatus in order to prevent oblique movement of the sheet.

An attempt to reduce the size of an apparatus, to provide high picture quality, and to reduce the production cost of the apparatus has been made using the above-described method. However, since a recording medium is conveyed while pressing a reference side thereof, a greater amount of worn powder of the recording medium is produced than in other conventional conveying methods.

SUMMARY OF THE INVENTION

The present invention has been made in consideration of the above-described problems.

It is an object of the present invention to provide a sheet feeding device having a simpler configuration which can further reduce the size of the main body of a recording apparatus, provide high picture quality, reduce the production cost of the apparatus, and solve various kinds of problems caused, for example, by powder from wearing of the recording medium.

In accordance with these objects, there is provided a sheet feeding device comprising feeding means for feeding a mounted sheet, first drive transmission means for selectively transmitting a drive to the feeding means, conveying means for conveying the sheet fed by the feeding means and and a second drive transmission means for selectively transmitting a drive to the conveying means. A supporting means intricately supports the feeding means, the conveying means, the first drive transmission means and the second drive transmission means.

In yet another aspect of the present invention there is provided a sheet conveying device comprising a guide for regulating a lateral position of a sheet by contacting one side-end of the sheet, a conveying means for conveying the sheet while pressing it against the guide as the side-end portion of the sheet is contacting the guide, a drive transmission means for selectively transmitting a drive to the conveying means and a cover for covering the drive transmission means.

In still another aspect of the present invention there is provided a sheet conveying device comprising mounting means for mounting sheets, feeding means for feeding a sheet mounted in the mounting means, a separation pawl for separating a sheet from other mounted sheet in the mounting means in cooperation with the feeding means while contacting one side portion of a leading end portion of the sheet mounted in the mounting means, a guide for regulating a lateral position of the sheet fed by the feeding means at the side contactng the separation pawl, conveying means for conveying the sheet fed by the feeding means while pressing the sheet against the guide as the end portion of the sheet is contacting the separation pawl, drive transmission means for selectively transmitting a drive to the conveying means, a cover for covering the drive transmission means and a supporting means for intricately supporting the feeding means, conveying means, drive transmission means and the cover.

In still another aspect of the invention each of the above sheet conveying embodiments is provided in conjuction with an image forming apparatus.

The foregoing and other objects, advantages and features of the present invention will become more apparent from the following description of the preferred embodiment taken in conjuction with the accompanying drawings.

DETAILED DESCRIPTION OF THE PREFERRED EMBODIMENT

Figure 1:
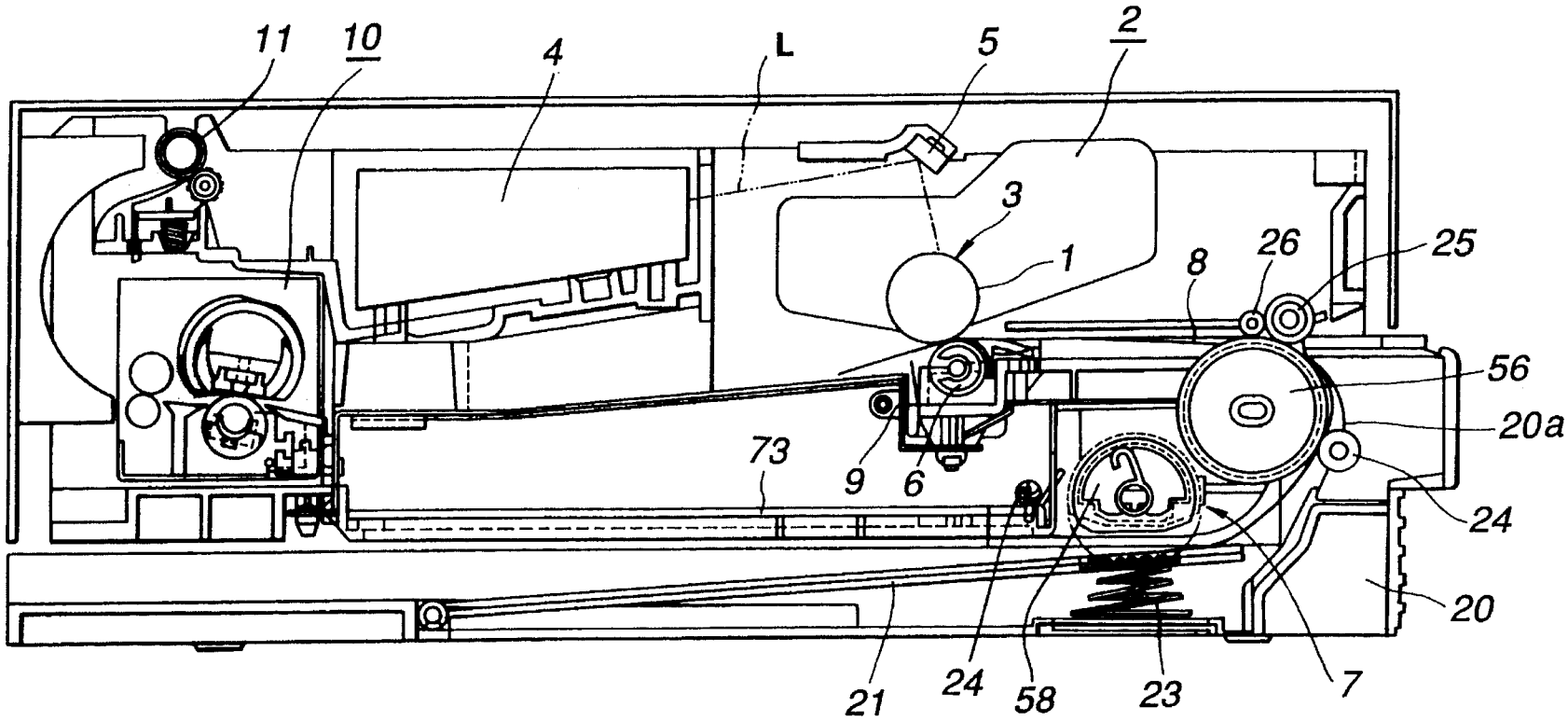
FIG. 1 is a cross-sectional view showing an image forming apparatus according to an embodiment of the present invention.
Figure 2:
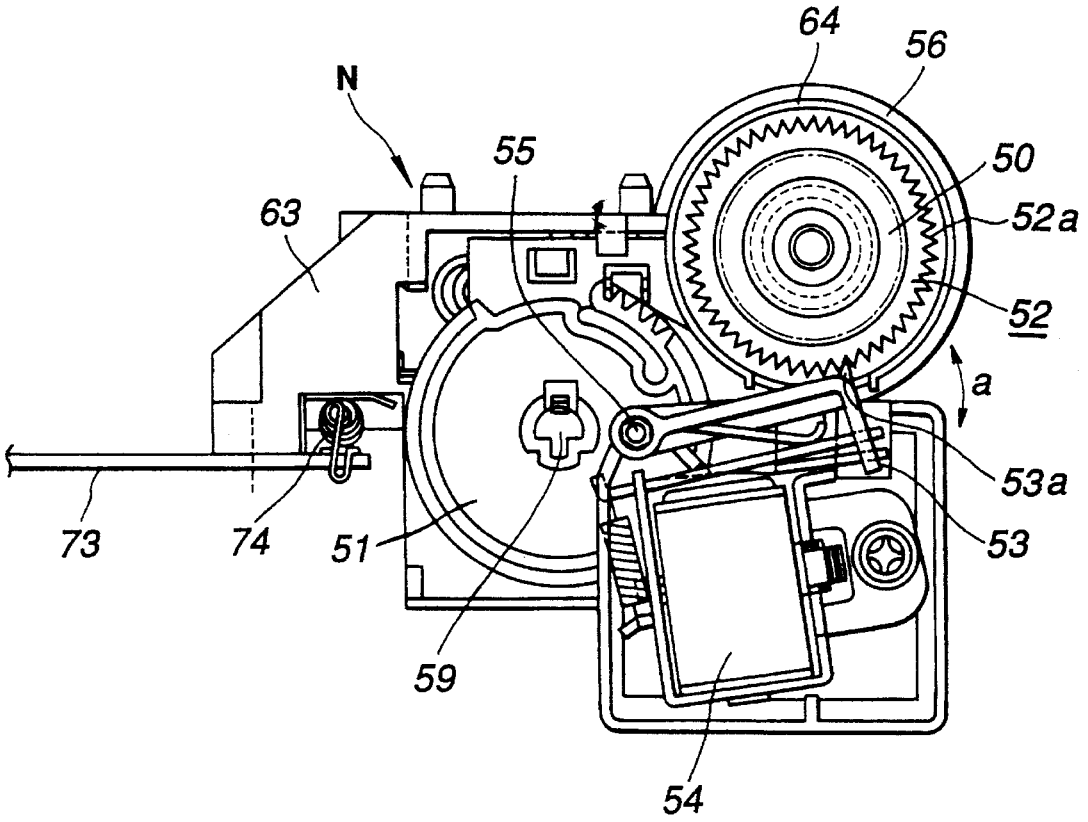
FIG. 2 is a front view of the sheet conveying unit.

FIG. 1 illustrates a sheet-feeding/conveying unit mounted in an electrophotographic laser-beam printer (LBP) of a laser-beam scanning exposure/transfer type according to an embodiment of the present invention.

In FIG. 1, a drum-type electrophotographic photosensitive member (hereinafter abbreviated as a drum) 1 is disposed within process cartridge 2, and is rotatably driven around a supporting shaft at a predetermined circumferential speed. A photosensitive member having an organic or inorganic photoconductive layer is provided on the circumferential surface of a drum-shaped base member of drum 1.

The surface of drum 1 is uniformly charged at a predetermined positive or negative potential by a primary charger (not shown) within process cartridge 2 while being rotated, and is then subjected to scanning writing of target image information at exposure portion 3 with laser-beam scanning exposure L by laser scanner 4. Thus, an electrostatic latent image corresponding to the target image information is sequentially formed on the surface of drum 1.

Laser-beam deflecting mirror 5 deflects laser beam L emitted from laser scanner 4 to exposure portion 3 facing drum 1.

Then, the surface of drum 1 having the latent image thereon is developed with toner by a developing unit (not shown) within process cartridge 2, whereby a toner image is visualized.

Thereafter, the toner image is sequentially transferred onto a sheet individually fed by sheet-feeding mechanism 7 to a position between transfer roller 6 and drum 1.

The toner image is transferred from the surface of drum 1 onto the sheet by charging the sheet to a polarity opposite to that of the charged polarity of the toner image. The sheet is charged by tranfer roller 6 disposed at the back side of the sheet. The sheet passing through the position of transfer roller 6 is separated from the surface of drum 1 by being subjected to charge removal by separation/charge-removal needle 9 maintained at a potential of an opposite polarity to the polarity of transfer roller 6. The sheet is then guided to fixing unit 10, in which the unfixed toner image on the sheet is fixed as a permanent image.

Thereafter, the sheet is conveyed to a pair of sheet-discharging rollers 11 as a transfer material having a fixed image, and the sheet is discharged onto a sheet-discharge tray (not shown).

Untransferred toner particles and the like may remain on the surface of drum 1 after the transfer of the toner image and are removed by a cleaning unit (not shown) within process cartridge 2, so that the drum 1 is repeatedly used for image formation.

Next, the sheet feeding/conveying unit of the present embodiment will be described in detail with reference to FIGS. 2 through 7.

A main motor (not shown) is provided in the main body of the apparatus, and gears are disposed so as to mesh conveying-roller gear 50 and sheet-feeding-roller driving partial gear 51 by a gear train (not shown). The gear meshing sheet-feeding-roller driving partial gear 51 is disposed so as to mesh sheet-feeding-roller driving partial gear 51 at a non-geared portion thereof. A sheet-feeding-roller solenoid (not shown) is caught by sheet-feeding-roller stopper 50*a* to stop rotation. Conveying-roller driving gear 66 provides conveying-roller gear 50 with a driving force.

Clutch 52 incorporates a known planetary gear train. By rotating latch pawl 53 around shaft 55 in the direction of arrow "a" by solenoid 54 (see FIG. 2), pawl portion 53*a* is engaged or disengaged with teeth of the outer circumference of sun gear 52*a* to start or stop the rotation of sun gear 52*a*, whereby the transmission of the drive to conveying roller 56 disposed on the shaft of clutch 52 is controlled.

If powder from the recording paper, and the like adheres to the contact portion between latch pawl 53 and sun gear (rotatable control member) 52*a*, the friction between latch pawl 53 and sun gear 52*a* increases, and latch pawl 53 will not disengage from sun gear 52*a*. If powder from the recording paper and the like adheres to sun gear 52*a*, latch pawl 53 does not engage the corresponding position of sun gear 52*a* and latch pawl 53 will disengage from sun gear 52*a*.

In order to overcome such problems, clutch cover 64 prevents intrusion into the mechanism of powder from the recording paper, and the like. In addition, a wall (not shown) is provided in main frame 70 in order to prevent intrusion of powder from the recording paper, and the like. Clutch cover 64 is configured integral with bearing unit 64*a* so as to also function as the bearing of output shaft 52*b* of sun gear 52*a*. Accordingly, clutch cover 64 can be provided close to output shaft 52*b* to more effectively prevent intrusion of powder from the recording paper, and the like.

Figure 4:
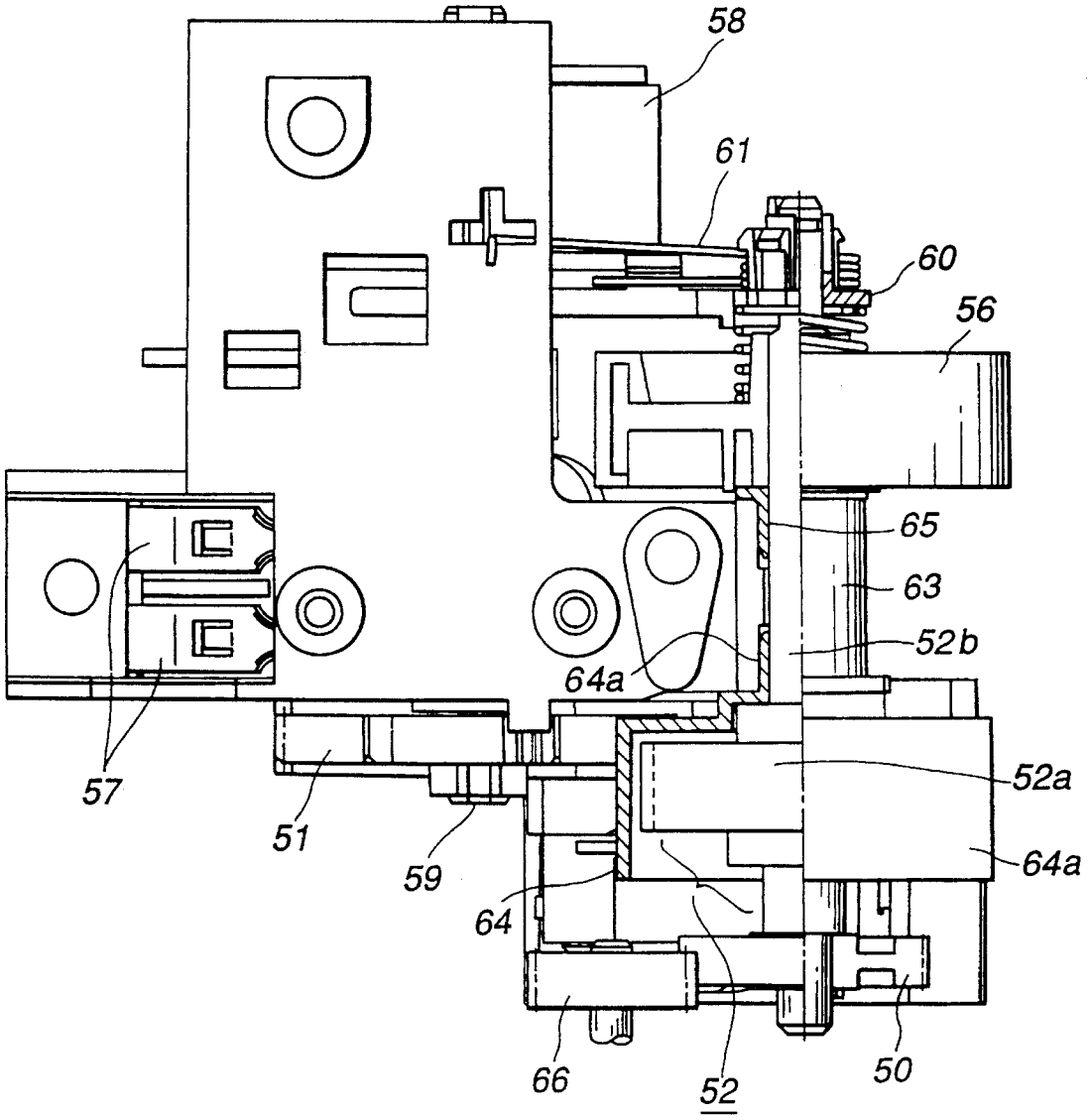
FIG. 4 is a plan view of the sheet conveying unit

With reference to FIG. 4, output-shaft bearing 65 holds output shaft 52*b* at a predetermined position together with clutch cover 64. Lead wires from solenoid 54 are subjected to pressure calking to solenoid terminals 57. Sheet-feeding roller 58 individually separates and conveys sheets 8 mounted in cassette 20, and is connected to sheet-feeding-roller driving partial gear 51 via sheet-feeding-roller shaft 59.

Sheet-feeding-roller lever 60 rotates around the shaft of clutch 52 to provide sheet-feeding roller 58 with a rotational force in the direction of arrow b (FIG. 5) by providing cam unit 50*a* formed on sheet-feeding roller 58 with a pressing force cooperating with sheet-feeding-roller spring 61.

Figure 5:
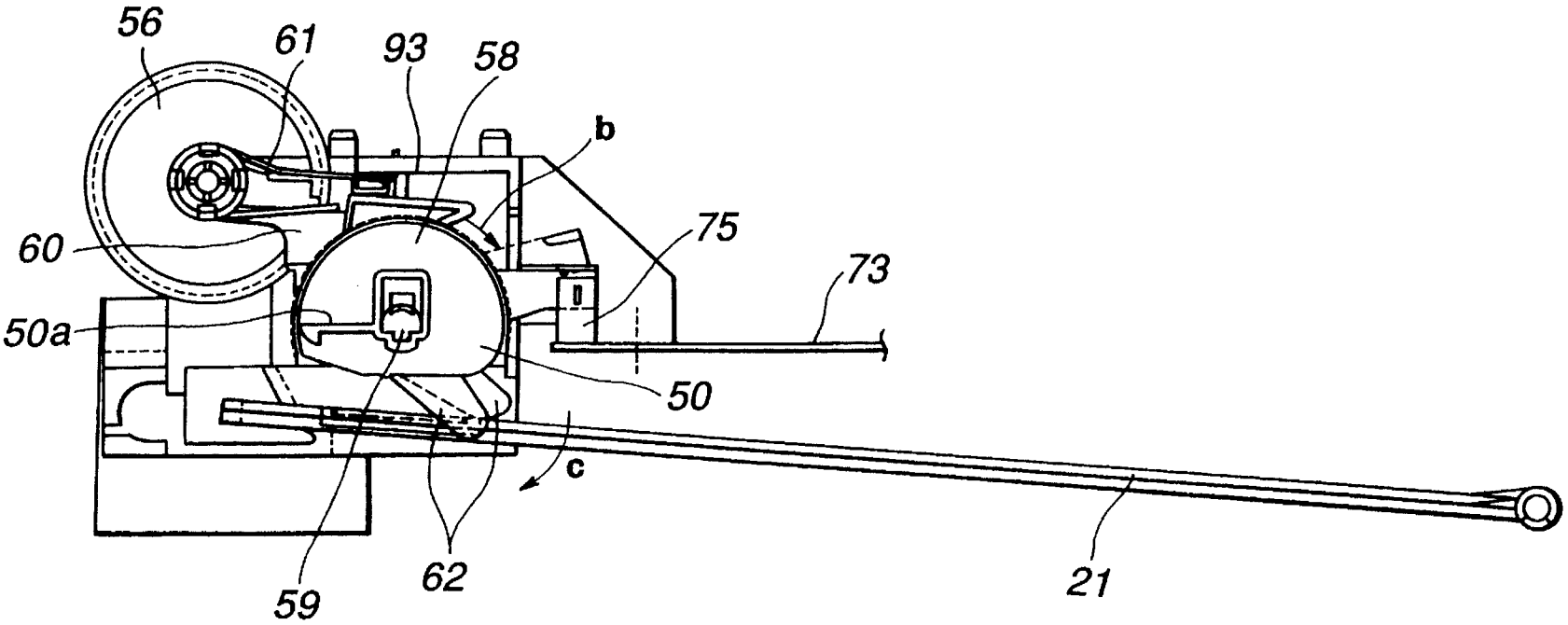
FIG. 5 is a cross-sectional view of the sheet conveying unit.
Figure 6:
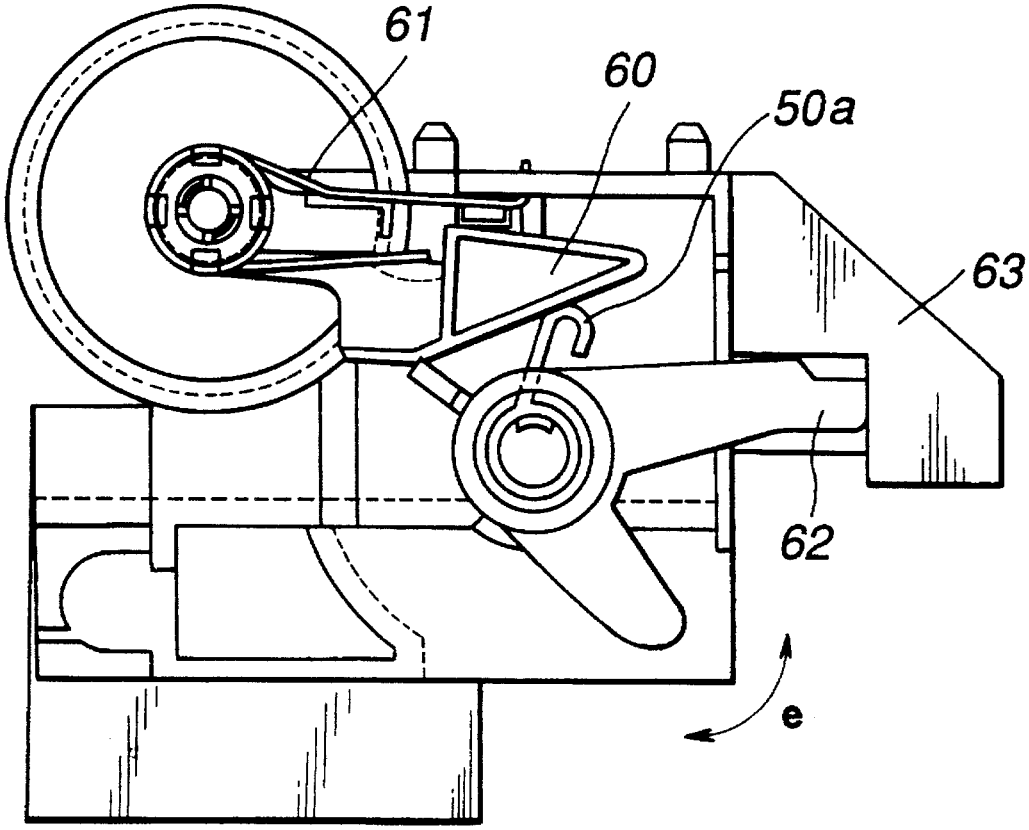
FIG. 6 is a diagram illustrating the positional relationship between a sheet-feeding-roller lever and a sheet-feeding-roller cam in the present embodiment.

When no sheet is present on intermediate plate 21, sheet-presence sensor arm 62 rotates in the direction of arrow c to detect the absence of sheets (see FIG. 5). Sheet-presence sensor arm 62 is capable of rocking back and forth in the directions of arrows E, as illustrated in FIG. 6.

Figure 7:
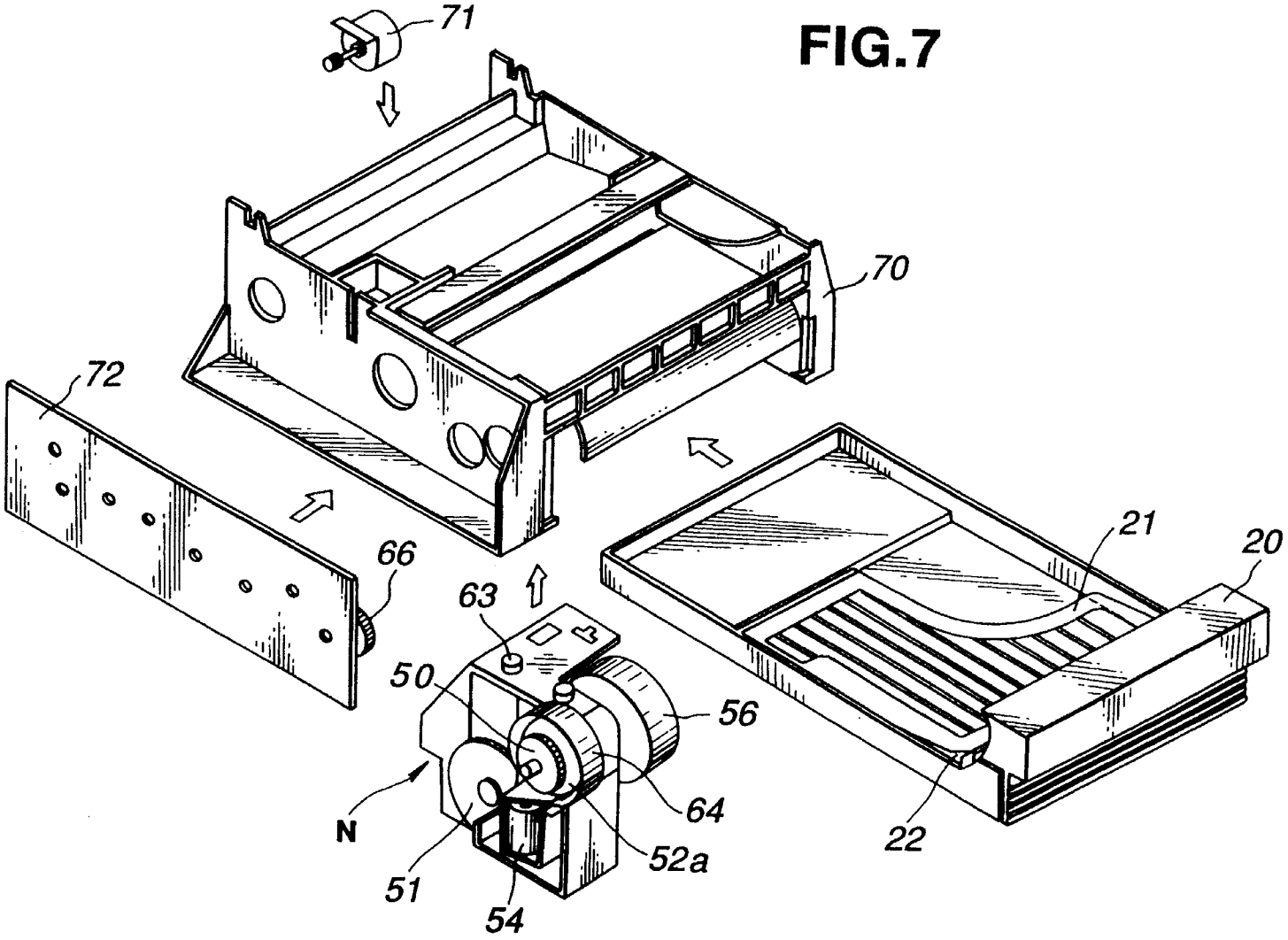
FIG. 7 is a diagram illustrating the manner of assembling components in the main body of an image forming apparatus.
Figure 8:
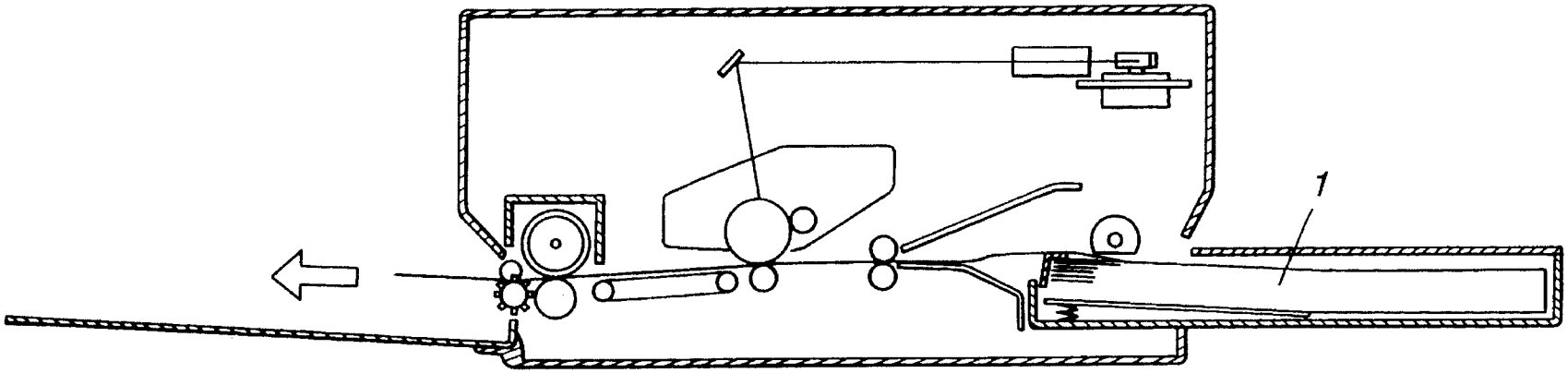
FIG.8 (PRIOR ART)
FIG. 8 is a diagram illustrating the configuration of a conventional image forming apparatus.
Figure 9:
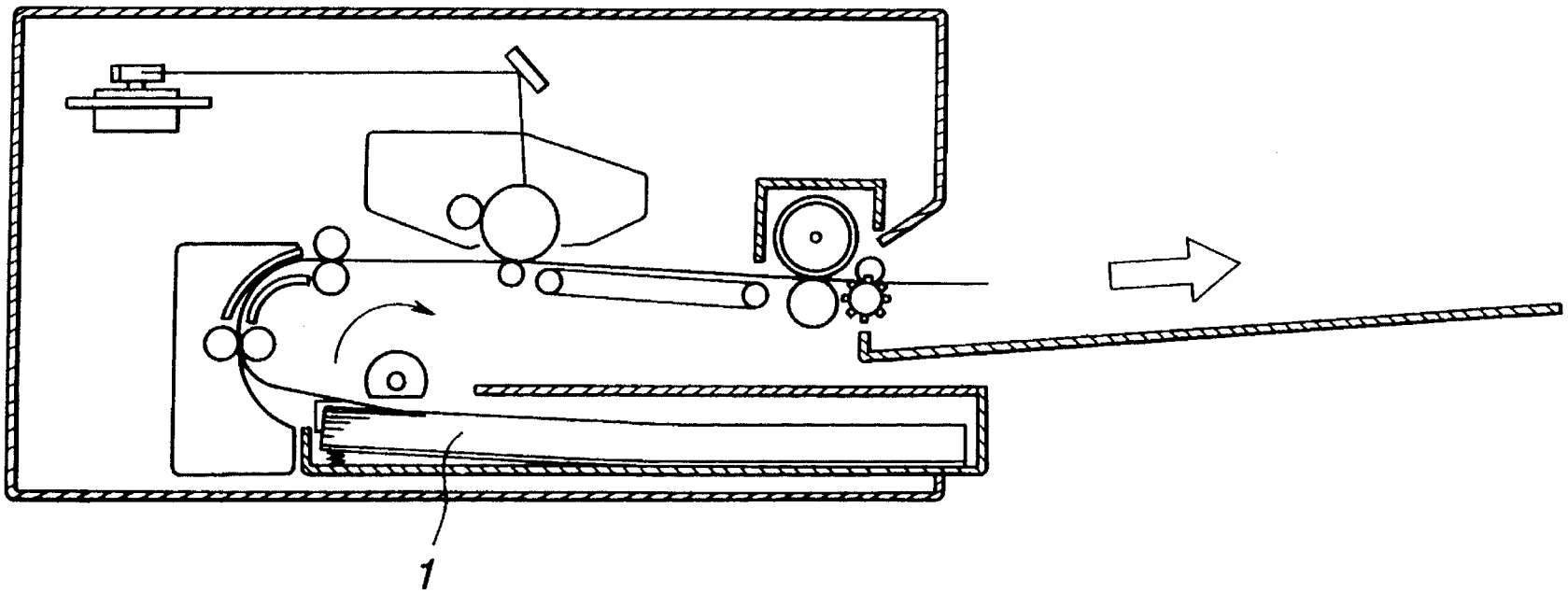
FIG.9 (PRIOR ART)
FIG. 9 is a diagram illustrating the configuration of another conventional image forming apparatus.
Figure 10:
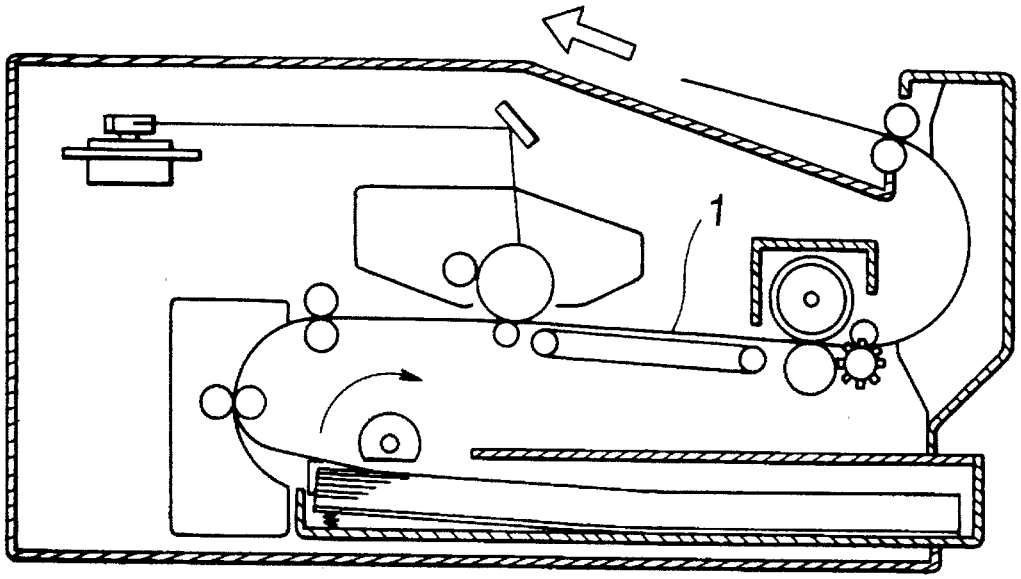
FIG.10 (PRIOR ART)
FIG. 10 is a diagram illustrating the configuration of still another coventional image forming apparatus.

The above-described components are disposed on sheet-feeding frame 63. In addition, sheet-presence sensor arm 62 is rotatably disposed on a boss portion of sheet-feeding frame 63. These components as shown in FIG. 7 constitute sheet-feeding unit N.

The rotation of conveying roller 56 provides a conveying force only for the uppermost sheet of sheets 8 mounted in sheet-feeding cassette 20. Only the uppermost sheet is separated and conveyed by separation pawl 22 (see FIG. 7). At that time, a predetermined pressing force is provided between sheets 8 and sheet-feeding roller 58 by the cooperation of intermediate plate 21 and pressing spring 23 (shown in FIG. 1).

The separated sheet 8 is conveyed along guide 20*a* serving as conveying guide means from sheet-feeding cassette 20 shown in FIG. 1 to a portion between first obliquely-feeding roller 24 and conveying roller 56. The sheet 8 is conveyed in synchronization with a rotational speed provided by a driving source (not shown) to pass between second obliquely-feeding roller 25 and conveying roller 56 and between third obliquely-feeding roller 26 and conveying roller 56, and reaches a pressing portion between drum 1 and transfer roller 6.

Figure 3:
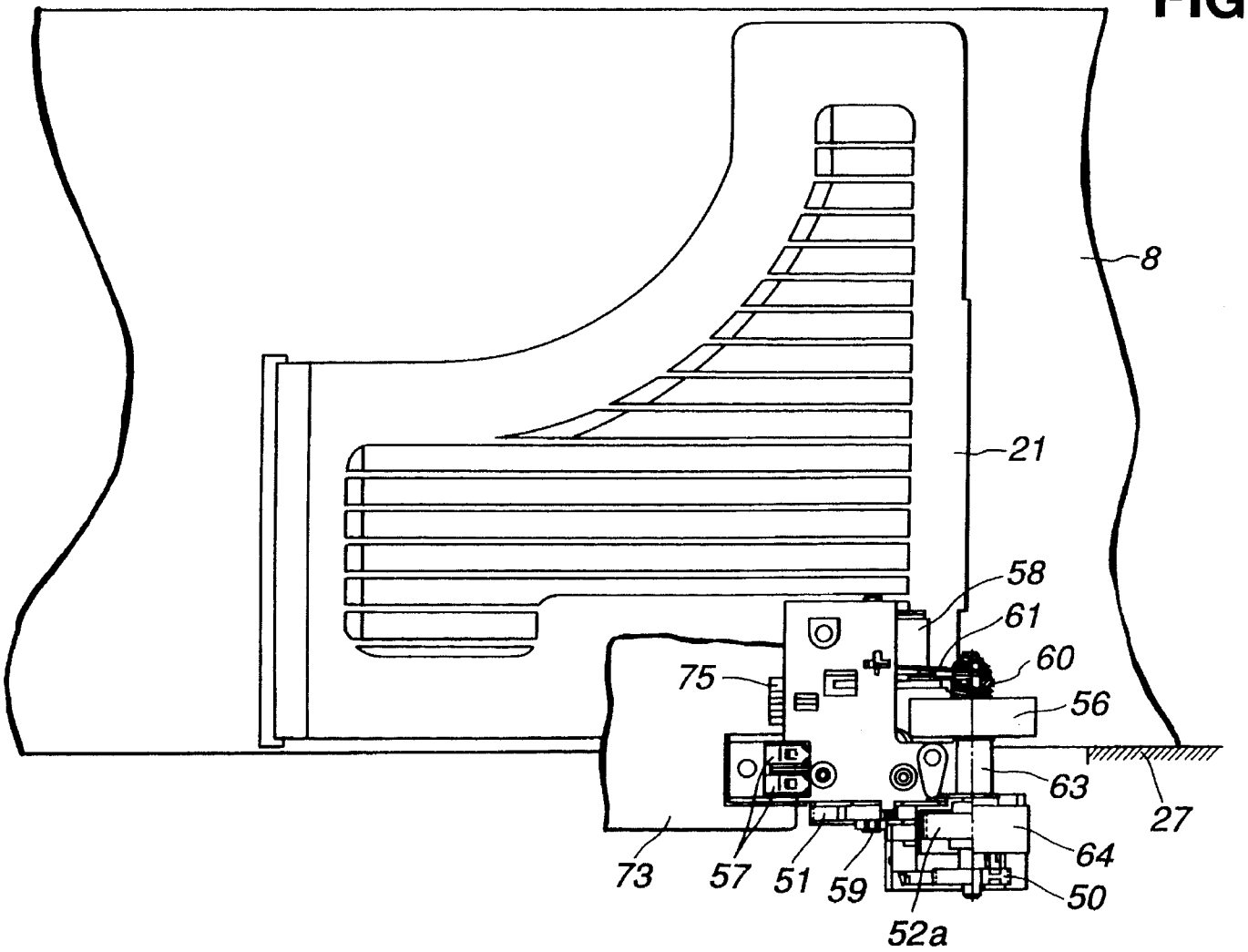
FIG. 3 is a plan view of the sheet conveying unit and sheet tray.

First through third obliquely-feeding rollers 24–26 are pressed against conveying roller 56 by a pressing mechanism (not shown) at obliquely-feeding angles of $\theta_1=1°$, $\theta_2=4°$ and $\theta_3=4°$, respectively, and with pressing forces of 400 g, 400 g and 300 g, respectively, in a direction to press the side-end of sheet 8 against a main-body reference guide (not shown, but its conceptual position is shown as reference numeral 27 in FIG. 3).

FIG. 7 illustrates the positional relationship between the above-described sheet-feeding frame 63 and other components in the main body of the image forming apparatus.

In FIG. 7, reference numeral 70 represents a main frame on which all components are assembled. Main motor 71, serving as a driving source for all the components, is mounted on main frame 70. Gears to supply all non-driving components (conveying roller 56, sheet-feeding roller 58, drum 1, fixing unit 10 and sheet-discharging roller 11) with the driving force from main motor 71 are mounted on driving unit 72.

Sheet-feeding frame 63 is assembled on main frame 70 by insertion in the indicated direction. Only by this assembling operation, connection with predetermined gears on driving unit 72 is effected, electrical connection with spring contact 74 and solenoid terminals 57 on main substrate 73 which performs electric control of the main body of the recording apparatus is effected, and sheet-presence sensor arm 62 is accommodated within a slit in optical sheet-presence sensor 75 on main substrate 73. As shown in FIG. 5, when sheets 8 are absent, a flag portion of sheet-presence sensor arm 62 moves in the direction of arrow b and enters sheet-presence sensor 75. When sheets 8 are present on intermediate plate 21, the flag portion of sheet-presence sensor arm 62 disengages from sheet-presence sensor 75.

As described above, according to the configuration of the present embodiment, the components relating to feeding and conveyance of sheets can be assembled as one unit. It is thereby possible to improve positional accuracy in the components, and to perform stable conveyance of sheets. In addition, it becomes possible to reduce the number of assembling processes, and therefore to provide a less expensive image forming apparatus.

Moreover, by adopting single-side oblique conveyance in which a recording medium is conveyed while its reference side is pressed, problems caused by a large amount of worn powder from the recording medium produced in a conventional conveying method can be prevented.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims.

What is claimed is:

1. A sheet feeding device mountable on a main body including a frame and a contact for transmitting an electrical control signal, said sheet feeding device comprising:

feeding means for feeding a sheet;

drive transmission means for selectively transmitting a drive to said feeding means;

supporting means for supporting said feeding means and said drive transmission means; and a terminal, supported by said supporting means, and electrically contactable to the contact of the main body by mounting said supporting means on the frame of the main body, whereby a control signal for controlling said drive transmission is transmitted from the contact to said terminal.

2. A device according to claim 1, wherein said drive transmission means comprises a clutch.

3. A device according to claim 2, further comprising a pawl for controlling the rotation of said clutch.

4. A device according to claim 3, further comprising a cover for covering said clutch.

5. A device according to claim 4, wherein said cover is disposed between sheet conveying means and said drive transmission means.

6. A sheet conveying device, comprising:

a guide for regulating a lateral position of a sheet by contacting one side-end of the sheet;

conveying means for conveying the sheet while pressing it against said guide as the side-end portion of the sheet is contacting said guide;

drive transmission means for selectively transmitting a drive to said conveying means, said drive transmission means comprising a control rotator having an outer circumference tooth gear and a pawl selectively engageable with said outer circumference tooth gear of said control rotator, said drive transmission means controlling transmission of a drive operation by selectively engaging or disengaging the pawl with said outer circumference tooth gear; and a cover for covering said control rotator.

7. A device according to claim 6, wherein said conveying means comprises a conveying roller rotating in contact with the sheet and an obliquely-feeding roller for urging the sheet against said guide in cooperation with said conveying roller.

8. A device according to claim 7, wherein said drive transmission means includes a shaft common to said conveying roller.

9. A device according to claim 8, wherein said cover is disposed between said conveying roller and said drive transmission means.

10. A device according to claim 9, wherein said cover integrally includes a bearing for supporting said shaft.

11. A device according to claim 7, further comprising conveying guide means for guiding the sheet so that it is conveyed while being curved around said conveying roller.

12. A device according to claim 6, further comprising supporting means for integrally supporting said conveying means, said drive transmission means and said cover.

13. A sheet conveying device, comprising:

mounting means for mounting sheets;

feeding means for feeding a sheet mounted in said mounting means;

a separation pawl for separating a sheet from other mounted sheets in said mounting means in cooperation with said feeding means while contacting one side portion of a leading-end portion of the sheet mounted in said mounting means;

a guide for regulating the lateral position of the sheet fed by said feeding means at the side contacting said separation pawl;

conveying means for conveying the sheet fed by said feeding means while pressing the sheet against said guide as the end portion of the sheet is contacting said separation pawl;

drive transmission means for selectively transmitting a drive to said conveying means, said drive transmission means comprising a control rotator having an outer circumference tooth gear and a pawl selectively engageable with said outer circumference tooth gear of said control rotator, said drive transmission means controlling transmission of a drive operation by selectively engaging or disengaging the pawl with said outer circumference tooth gear;

a cover for covering said control rotator; and supporting means for integrally supporting said feeding means, said conveying means, said drive transmission means and said cover.

14. A device according to claim 13, wherein said conveying means comprises a first rotating member for conveying the sheet in contact therewith.

15. A device according to claim 14, wherein said conveying means further comprises a second rotating member for conveying the sheet in cooperation with said first rotating member, and wherein said second rotating member is disposed at an inclined state relative to the direction of conveyance of the sheet.

16. A device according to claim 15, further comprising conveying guide means for guiding the sheet curved around said first rotating member.

17. A device according to claim 13, wherein said feeding means contacts an end portion of the sheet mounted in said mounting means at an end thereof and at the side contacting said separation pawl.

18. A device according to claim 13, wherein said cover is disposed between said coveying means and said drive transmission means.

19. A device according to claim 18, wherein said drive transmission means and said conveying means include a common shaft, and wherein said cover integrally includes a bearing for supporting said shaft.

20. An image forming apparatus mountable on a main body including a frame and a contact for transmitting an electrical control signal, said apparatus comprising:

feeding means for feeding a sheet;

drive transmission means for selectively transmitting a drive to said feeding means;

supporting means for supporting said feeding means and said drive transmission means;

a terminal, supported by said supporting means, and electrically contactable to the contact of the main body by mounting said supporting means on the frame of the main body, whereby a control signal for controlling said drive transmission is transmitted from the contact to said terminal; and image forming means for forming an image on a sheet fed by said feeding means.

21. An image forming apparatus, comprising:

a guide for regulating a lateral position of a sheet by contacting one side-end of the sheet;

conveying means for conveying the sheet while pressing it against said guide as the side-end portion of the sheet is contacting said guide;

drive transmission means for selectively transmitting a drive to said conveying means, said drive transmission means comprising a control rotator having an outer circumference tooth gear and a pawl selectively engageable with said outer circumference tooth gear of said control rotator, said drive transmission means controlling transmission of a drive operation by selectively engaging or disengaging the pawl with said outer circumference tooth gear;

a cover for covering said control rotator; and image forming means for forming an image on the sheet conveyed by said conveying means.

22. An image forming apparatus, comprising:

mounting means for mounting sheets;

feeding means for feeding a sheet mounted in said mounting means;

a separation pawl for separating a sheet from other mounted sheets in said mounting means in cooperation with said feeding means while contacting one side portion of a leading-end portion of the sheet mounted in said mounting means;

a guide for regulating the lateral position of the sheet fed by said feeding means at the side contacting said separation pawl;

conveying means for conveying the sheet fed by said feeding means while pressing the sheet against said guide as the end portion of the sheet is contacting said separation pawl;

drive transmission means for selectively transmitting a drive to said conveying means, said drive transmission means comprising a control rotator having an outer circumference tooth gear and a pawl selectively engageable with said outer circumference tooth gear of said control rotator, said drive transmission means controlling transmission of a drive operation by selectively engaging or disengaging the pawl with said outer circumference tooth gear;

a cover for covering said control rotator;

supporting means for integrally supporting said feeding means, said conveying means, said drive transmission means and said cover; and image forming means for forming an image on the sheet conveyed by said conveying means.

* * * * *